US009899029B2

(12) United States Patent
Purnhagen et al.

(10) Patent No.: US 9,899,029 B2
(45) Date of Patent: Feb. 20, 2018

(54) CODING OF MULTICHANNEL AUDIO CONTENT

(71) Applicant: DOLBY INTERNATIONAL AB, Amsterdam, Zuidoost (NL)

(72) Inventors: Heiko Purnhagen, Sundyberg (SE); Harald Mundt, Furth (DE); Kristofer Kjoerling, Solna (SE)

(73) Assignee: Dolby International AB, Amsterdam (NL)

( * ) Notice: Subject to any disclaimer, the term of this patent is extended or adjusted under 35 U.S.C. 154(b) by 0 days.

(21) Appl. No.: 15/490,810

(22) Filed: Apr. 18, 2017

(65) Prior Publication Data

US 2017/0221489 A1 Aug. 3, 2017

Related U.S. Application Data

(63) Continuation of application No. 14/916,176, filed as application No. PCT/EP2014/069044 on Sep. 8, 2014, now Pat. No. 9,646,619.

(Continued)

(51) Int. Cl.

*G10L 19/008* (2013.01)
*G10L 19/02* (2013.01)

(Continued)

(52) U.S. Cl.

CPC ..... *G10L 19/008* (2013.01); *G10L 19/02* (2013.01); *G10L 19/24* (2013.01); *H04S 5/00* (2013.01);

(Continued)

(58) Field of Classification Search

CPC ..... G10L 19/008; G10L 19/02; G10L 19/24; H04S 5/00; H04S 2400/03; H04S 2420/03

See application file for complete search history.

(56) References Cited

U.S. PATENT DOCUMENTS 8,180,061 B2 5/2012 Hilpert
8,214,223 B2 7/2012 Thesing (Continued)

FOREIGN PATENT DOCUMENTS

JP 2009-506372 2/2009
JP 2009-516861 4/2009

(Continued)

OTHER PUBLICATIONS

Breebaart, J. et al "Spatial Audio Processing—Ch. 6 MPEG Surround" in: Spatial Audio Processing, Jan. 1, 2007, John Wiley & Sons, Ltd. pp. 93-115.

(Continued)

*Primary Examiner* — Sonia Gay

(57) ABSTRACT

There are provided decoding and encoding methods for encoding and decoding of multichannel audio content for playback on a speaker configuration with N channels. The decoding method comprises decoding, in a first decoding module, M input audio signals into M mid signals which are suitable for playback on a speaker configuration with M channels; and for each of the N channels in excess of M channels, receiving an additional input audio signal corresponding to one of the M mid signals and decoding the input audio signal and its corresponding mid signal so as to generate a stereo signal including a first and a second audio signal which are suitable for playback on two of the N channels of the speaker configuration.

12 Claims, 7 Drawing Sheets

Related U.S. Application Data

(60) Provisional application No. 61/973,628, filed on Apr. 1, 2014, provisional application No. 61/893,770, filed on Oct. 21, 2013, provisional application No. 61/877,189, filed on Sep. 12, 2013.

(51) Int. Cl.
*G10L 19/24* (2013.01)
*H04S 5/00* (2006.01)

(52) U.S. Cl.
CPC ..... *H04S 2400/03* (2013.01); *H04S 2420/03* (2013.01)

(56) References Cited

U.S. PATENT DOCUMENTS

| | | | |
|---|---|---|---|
| 2009/0299756 | A1 | 12/2009 | Davis |
| 2010/0324915 | A1 | 12/2010 | Seo |
| 2011/0013790 | A1 | 1/2011 | Hilpert |
| 2011/0022402 | A1 | 1/2011 | Engdegard |
| 2011/0224994 | A1 | 9/2011 | Norvell |
| 2012/0230497 | A1 | 9/2012 | Dressler |
| 2013/0121411 | A1 | 5/2013 | Robillard |
| 2014/0016784 | A1 | 1/2014 | Sen |
| 2016/0027446 | A1 | 1/2016 | Purnhagen et al. |

FOREIGN PATENT DOCUMENTS

| | | |
|---|---|---|
| JP | 2009-522894 | 6/2009 |
| JP | 2011-528129 | 11/2011 |
| JP | 2012-141633 | 7/2012 |
| JP | 2013-508770 | 3/2013 |
| JP | 2013-525830 | 6/2013 |
| WO | 2008/046531 | 4/2008 |
| WO | 2012/125855 | 9/2012 |
| WO | 2013/064957 | 5/2013 |
| WO | 2013/173314 | 11/2013 |
| WO | 2013/186345 | 12/2013 |
| WO | 2013/192111 | 12/2013 |
| WO | 2015/036351 | 3/2015 |

OTHER PUBLICATIONS

Cheng, B. et al "A General Compression Approach to Multi-Channel Three-Dimensional Audio" IEEE Transactions on Audio, Speech, and Language Processing, vol. 21, Issue 8, pp. 1676-1688, Aug. 2013.

Hotho, G. et al "A Backward-Compatible Multichannel Audio Codec" IEEE Transactions on Audio, Speech, and Language Processing, vol. 16, Issue 1, pp. 83-93, Jan. 2008.

CODING OF MULTICHANNEL AUDIO CONTENT

CROSS-REFERENCE TO RELATED APPLICATIONS

The present application is a continuation of U.S. application Ser. No. 14/916,176 filed Mar. 2, 2016 now allowed which was a 371 national phase filing from PCT International Application No. PCT/EP2014/069044 filed Sep. 8, 2014 which claims the benefit of the filing date of U.S. Patent Application No. 61/877,189 filed on Sep. 12, 2013; U.S. Patent Application No. 61/893,770 filed Oct. 21, 2013 and U.S. Patent Application No. 61/973,628 filed Apr. 1, 2014 which are hereby incorporated by reference in their entirety.

TECHNICAL FIELD

The disclosure herein generally relates to coding of multichannel audio signals. In particular, it relates to an encoder and a decoder for encoding and decoding of a plurality of input audio signals for playback on a speaker configuration having a certain number of channels.

BACKGROUND

Multichannel audio content corresponds to a speaker configuration having a certain number of channels. For example, multichannel audio content may correspond to a speaker configuration with five front channels, four surround channels, four ceiling channels, and a low frequency effect (LFE) channel. Such channel configuration may be referred to as a 5/4/4.1, 9.1+4, or 13.1 configuration. Sometimes it is desirable to play back the encoded multichannel audio content on a playback system having a speaker configuration with fewer channels, i.e. speakers, than the encoded multichannel audio content. In the following, such a playback system is referred to as a legacy playback system. For example, it may be desirable to play back encoded 13.1 audio content on a speaker configuration with three front channels, two surround channels, two ceiling channels, and an LFE channel. Such channel configuration is also referred to as a 3/2/2.1, 5.1+2, or 7.1 configuration.

According to prior art, a full decoding of all channels of the original multichannel audio content followed by downmixing to the channel configuration of the legacy playback system would be required. Apparently, such an approach is computationally inefficient since all channels of the original multichannel audio content needs to be decoded. There is thus a need for a coding scheme that allows to directly decode a downmix suitable for a legacy playback system

BRIEF DESCRIPTION OF THE DRAWINGS

Example embodiments will now be described with reference to the accompanying drawings, on which.

All the figures are schematic and generally only show parts which are necessary in order to elucidate the disclosure, whereas other parts may be omitted or merely suggested. Unless otherwise indicated, like reference numerals refer to like parts in different figures.

DETAILED DESCRIPTION

Figure 1:
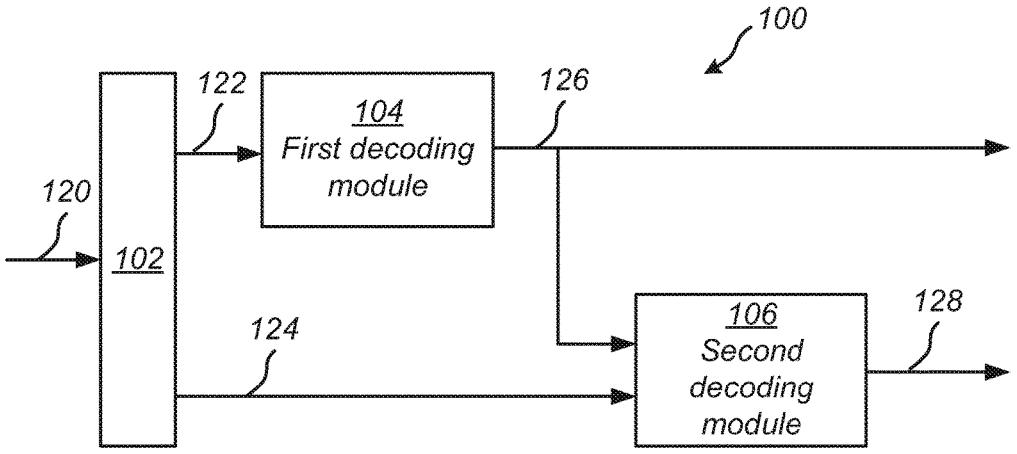
FIG. 1 illustrates a decoding scheme according to example embodiments.

In view of the above it is thus an object to provide encoding/decoding methods for encoding/decoding of multichannel audio content which allow for efficient decoding of a downmix suitable for a legacy playback system.

I. Overview—Decoder

According to a first aspect, there is provided a decoding method, a decoder, and a computer program product for decoding multichannel audio content.

According to exemplary embodiments, there is provided a method in a decoder for decoding a plurality of input audio signals for playback on a speaker configuration with N channels, the plurality of input audio signals representing encoded multichannel audio content corresponding to at least N channels, comprising:

receiving M input audio signals, wherein $1<M\leq N\leq 2M$;

decoding, in a first decoding module, the M input audio signals into M mid signals which are suitable for playback on a speaker configuration with M channels;

for each of the N channels in excess of M channels receiving an additional input audio signal corresponding to one of the M mid signals, the additional input audio signal being either a side signal or a complementary signal which together with the mid signal and a weighting parameter a allows reconstruction of a side signal;

decoding, in a stereo decoding module, the additional input audio signal and its corresponding mid signal so as to generate a stereo signal including a first and a second audio signal which are suitable for playback on two of the N channels of the speaker configuration;

whereby N audio signals which are suitable for playback on the N channels of the speaker configuration are generated.

The above method is advantageous in that the decoder does not have to decode all channels of the multichannel audio content and forming a downmix of the full multichannel audio content in case that the audio content is to be playbacked on a legacy playback system.

In more detail, a legacy decoder which is designed to decode audio content corresponding to an M-channel speaker configuration may simply use the M input audio signals and decode these into M mid signals which are suitable for playback on the M-channel speaker configuration. No further downmix of the audio content is needed on the decoder side. In fact, a downmix that is suitable for the legacy playback speaker configuration has already been prepared and encoded at the encoder side and is represented by the M input audio signals.

A decoder which is designed to decode audio content corresponding to more than M channels, may receive additional input audio signals and combine these with corresponding ones of the M mid signals by means of stereo decoding techniques in order to arrive at output channels corresponding to a desired speaker configuration. The proposed method is therefore advantageous in that it is flexible with respect to the speaker configuration that is to be used for playback.

According to exemplary embodiments the stereo decoding module is operable in at least two configurations depending on a bit rate at which the decoder receives data. The method may further comprise receiving an indication regarding which of the at least two configurations to use in the step of decoding the additional input audio signal and its corresponding mid signal.

This is advantageous in that the decoding method is flexible with respect to the bit rate used by the encoding/decoding system.

According to exemplary embodiments the step of receiving an additional input audio signal comprises:

receiving a pair of audio signals corresponding to a joint encoding of an additional input audio signal corresponding to a first of the M mid signals, and an additional input audio signal corresponding to a second of the M mid signals; and decoding the pair of audio signals so as to generate the additional input audio signals corresponding to the first and the second of the M mid signals, respectively.

This is advantageous in that the additional input audio signals may be efficiently coded pair wise.

According to exemplary embodiments, the additional input audio signal is a waveform-coded signal comprising spectral data corresponding to frequencies up to a first frequency, and the corresponding mid signal is a waveform-coded signal comprising spectral data corresponding to frequencies up to a frequency which is larger than the first frequency, and wherein the step of decoding the additional input audio signal and its corresponding mid signal according to the first configuration of the stereo decoding module comprises the steps of:

if the additional audio input signal is in the form of a complementary signal, calculating a side signal for frequencies up to the first frequency by multiplying the mid signal with the weighting parameter a and adding the result of the multiplication to the complementary signal; and upmixing the mid signal and the side signal so as to generate a stereo signal including a first and a second audio signal, wherein for frequencies below the first frequency the upmixing comprises performing an inverse sum-and-difference transformation of the mid signal and the side signal, and for frequencies above the first frequency the upmixing comprises performing parametric upmixing of the mid signal.

This is advantageous in that the decoding carried out by the stereo decoding modules enables decoding of mid signal and a corresponding additional input audio signal, where the additional input audio signal is waveform-coded up to a frequency which is lower than the corresponding frequency for the mid signal. In this way, the decoding method allows the encoding/decoding system to operate at a reduced bit rate.

By performing parametric upmixing of the mid signal is generally meant that the first and the second audio signal, for frequencies above the first frequency is parametrically reconstructed based on the mid signal.

According to exemplary embodiments, the waveform-coded mid signal comprises spectral data corresponding to frequencies up to a second frequency, the method further comprising:

extending the mid signal to a frequency range above the second frequency by performing high frequency reconstruction prior to performing parametric upmixing.

In this way, the decoding method allows the encoding/decoding system to operate at a bit rate which is even further reduced.

According to exemplary embodiments, the additional input audio signal and the corresponding mid signal are waveform-coded signals comprising spectral data corresponding to frequencies up to a second frequency, and the step of decoding the additional input audio signal and its corresponding mid signal according to the second configuration of the stereo decoding module comprises the steps of:

if the additional audio input signal is in the form of a complementary signal, calculating a side signal by multiplying the mid signal with the weighting parameter a and adding the result of the multiplication to the complementary signal; and performing an inverse sum-and-difference transformation of the mid signal and the side signal so as to generate a stereo signal including a first and a second audio signal.

This is advantageous in that the decoding carried out by the stereo decoding modules further enable decoding of mid signal and a corresponding additional input audio signal, where the additional input audio signal are waveform-coded up to the same frequency. In this way, the decoding method allows the encoding/decoding system to also operate at a high bit rate.

According to exemplary embodiments, the method further comprises: extending the first and the second audio signal of the stereo signal to a frequency range above the second frequency by performing high frequency reconstruction. This is advantageous in that the flexibility with respect to bit rate of the encoding/decoding system is further increased.

According to exemplary embodiments where the M mid signals are to be play backed on a speaker configuration with M channels, the method may further comprise:

extending the frequency range of at least one of the M mid signals by performing high frequency reconstruction based on high frequency reconstruction parameters which are associated with the first and the second audio signal of the stereo signal that may be generated from the at least one the M mid signals and its corresponding additional audio input signal.

This is advantageous in that the quality of the high frequency reconstructed mid signals may be improved.

According to exemplary embodiments where the additional input audio signal is in the form of a side signal, the additional input audio signal and the corresponding mid signal are waveform-coded using a modified discrete cosine transform having different transform sizes. This is advantageous in that the flexibility with respect to choosing transform sizes is increased.

Exemplary embodiments also relate to a computer program product comprising a computer-readable medium with instructions for performing any of the encoding methods disclosed above. The computer-readable medium may be a non-transitory computer-readable medium.

Exemplary embodiments also relate to decoder for decoding a plurality of input audio signals for playback on a speaker configuration with N channels, the plurality of input audio signals representing encoded multichannel audio content corresponding to at least N channels, comprising:

a receiving component configured to receive M input audio signals, wherein $1<M\leq N\leq 2M$;

a first decoding module configured to decode the M input audio signals into M mid signals which are suitable for playback on a speaker configuration with M channels;

a stereo coding module for each of the N channels in excess of M channels, the stereo coding module being configured to:

receive an additional input audio signal corresponding to one of the M mid signals, the additional input audio signal being either a side signal or a complementary signal which together with the mid signal and a weighting parameter a allows reconstruction of a side signal; and decode the additional input audio signal and its corresponding mid signal so as to generate a stereo signal including a first and a second audio signal which are suitable for playback on two of the N channels of the speaker configuration;

whereby the decoder is configured to generate N audio signals which are suitable for playback on the N channels of the speaker configuration.

II. Overview—Encoder

According to a second aspect, there are provided an encoding method, an encoder, and a computer program product for decoding multichannel audio content.

The second aspect may generally have the same features and advantages as the first aspect.

According to exemplary embodiments there is provided a method in an encoder for encoding a plurality of input audio signals representing multichannel audio content corresponding to K channels, comprising:

receiving K input audio signals corresponding to the channels of a speaker configuration with K channels;

generating M mid signals which are suitable for playback on a speaker configuration with M channels, wherein $1<M<K\leq 2M$, and K-M output audio signals from the K input audio signals, wherein 2M-K of the mid signals correspond to 2M-K of the input audio signals; and wherein the remaining K-M mid signals and the K-M output audio signals are generated by, for each value of K exceeding M:

encoding, in a stereo encoding module, two of the K input audio signals so as to generate a mid signal and an output audio signal, the output audio signal being either a side signal or a complementary signal which together with the mid signal and a weighting parameter a allows reconstruction of a side signal;

encoding, in a second encoding module, the M mid signals into M additional output audio channels; and including the K-M output audio signals and the M additional output audio channels in a data stream for transmittal to a decoder.

According to exemplary embodiments, the stereo encoding module is operable in at least two configurations depending on a desired bit rate of the encoder. The method may further comprise including an indication in the data stream regarding which of the at least two configurations that was used by the stereo encoding module in the step of encoding two of the K input audio signals.

According to exemplary embodiments, the method may further comprise performing stereo encoding of the K-M output audio signals pair wise prior to inclusion in the data stream.

According to exemplary embodiments where the stereo encoding module operates according to a first configuration, the step of encoding two of the K input audio signals so as to generate a mid signal and an output audio signal comprises:

transforming the two input audio signals into a first signal being a mid signal and a second signal being a side signal;

waveform-coding the first and the second signal into a first and a second waveform waveform-coded signal, respectively, wherein the second signal is waveform-coded up to first frequency and the first signal is waveform-coded up to a second frequency which is larger than the first frequency;

subjecting the two input audio signals to parametric stereo encoding in order to extract parametric stereo parameters enabling reconstruction of spectral data of the two of the K input audio signals for frequencies above the first frequency; and including the first and the second waveform-coded signal and the parametric stereo parameters in the data stream.

According to exemplary embodiments, the method further comprises:

for frequencies below the first frequency, transforming the waveform-coded second signal, which is a side signal, to a complementary signal by multiplying the waveform-coded first signal, which is a mid signal, by a weighting parameter a and subtracting the result of the multiplication from the second waveform-coded signal; and including the weighting parameter a in the data stream.

According to exemplary embodiments, the method further comprises:

subjecting the first signal, which is a mid signal, to high frequency reconstruction encoding in order to generate high frequency reconstruction parameters enabling high frequency reconstruction of the first signal above the second frequency; and including the high frequency reconstruction parameters in the data stream.

According to exemplary embodiments where the stereo encoding module operates according to a second configuration, the step of encoding two of the K input audio signals so as to generate a mid signal and an output audio signal comprises:

transforming the two input audio signals into a first signal being a mid signal and a second signal being a side signal;

waveform-coding the first and the second signal into a first and a second waveform waveform-coded signal, respectively, wherein the first and the second signal are waveform-coded up to second frequency; and including the first and the second waveform-coded signals.

According to exemplary embodiments, the method further comprises:

transforming the waveform-coded second signal, which is a side signal, to a complementary signal by multiplying the waveform-coded first signal, which is a mid signal, by a weighting parameter a and subtracting the result of the multiplication from the second waveform-coded signal; and including the weighting parameter a in the data stream.

According to exemplary embodiments, the method further comprises:

subjecting each of said two of the K input audio signals to high frequency reconstruction encoding in order to generate high frequency reconstruction parameters enabling high frequency reconstruction of said two of the K input audio signals above the second frequency; and including the high frequency reconstruction parameters in the data stream.

Exemplary embodiments also relate to a computer program product comprising a computer-readable medium with instructions for performing the encoding method of exemplary embodiments. The computer-readable medium may be a non-transitory computer-readable medium.

Exemplary embodiments also relate to an encoder for encoding a plurality of input audio signals representing multichannel audio content corresponding to K channels, comprising:

a receiving component configured to receive K input audio signals corresponding to the channels of a speaker configuration with K channels;

a first encoding module configured to generate M mid signals which are suitable for playback on a speaker configuration with M channels, wherein $1<M<K\leq 2M$, and K-M output audio signals from the K input audio signals, wherein 2M-K of the mid signals correspond to 2M-K of the input audio signals, and wherein the first encoding module comprises K-M stereo encoding modules configured to generate the remaining K-M mid signals and the K-M output audio signals, each stereo encoding module being configured to:

encode two of the K input audio signals so as to generate a mid signal and an output audio signal, the output audio signal being either a side signal or a complementary signal which together with the mid signal and a weighting parameter a allows reconstruction of a side signal; and a second encoding module configured to encode the M mid signals into M additional output audio channels, and a multiplexing component configured to include the K-M output audio signals and the M additional output audio channels in a data stream for transmittal to a decoder.

III. Example Embodiments

A stereo signal having a left (L) and a right channel (R) may be represented on different forms corresponding to different stereo coding schemes. According to a first coding scheme referred to herein as left-right coding "LR-coding" the input channels L, R and output channels A, B of a stereo conversion component are related according to the following expressions:

$$L=A;\ R=B.$$

In other words, LR-coding merely implies a pass-through of the input channels. A stereo signal being represented by its L and R channels is said to have an L/R representation or being on an L/R form.

According to a second coding scheme referred to herein as sum-and-difference coding (or mid-side coding "MS-coding") the input and output channels of a stereo conversion component are related according to the following expressions:

$$A=0.5(L+R);\ B=0.5(L-R).$$

In other words, MS-coding involves calculating a sum and a difference of the input channels. This is referred to herein as performing a sum-and-difference transformation. For this reason the channel A may be seen as a mid-signal (a sum-signal M) of the first and a second channels L and R, and the channel B may be seen as a side signal (a difference-signal S) of the first and second channels L and R. In case a stereo signal has been subject to sum- and difference coding it is said to have a mid/side (M/S) representation or being on a mid/side (M/S) form.

From a decoder perspective the corresponding expression is:

$$L=(A+B);\ R=(A-B).$$

Converting a stereo signal which is on a mid/side form to an L/R form is referred to herein as performing an inverse sum-and-difference transformation.

The mid-side coding scheme may be generalized into a third coding scheme referred to herein as "enhanced MS-coding" (or enhanced sum-difference coding). In enhanced MS-coding, the input and output channels of a stereo conversion component are related according to the following expressions:

$$A=0.5(L+R);\ B=0.5(L(1-a)-R(1+a)),$$

$$L=(1+a)A+B;\ R=(1-a)A-B,$$

where a is a weighting parameter. The weighting parameter a may be time- and frequency variant. Also in this case the signal A may be thought of as a mid-signal and the signal B as a modified side-signal or complementary side signal. Notably, for a=0, the enhanced MS-coding scheme degenerates to the mid-side coding. In case a stereo signal has been subject to enhanced mid/side coding it is said to have a mid/complementary/a representation (M/c/a) or being on a mid/complementary/a form.

In accordance to the above a complementary signal may be transformed into a side signal by multiplying the corresponding mid signal with the parameter a and adding the result of the multiplication to the complementary signal.

FIG. 1 illustrates a decoding scheme 100 in a decoding system according to exemplary embodiments. A data stream 120 is received by a receiving component 102. The data stream 120 represents encoded multichannel audio content corresponding to K channels. The receiving component 102 may demultiplex and dequantize the data stream 120 so as to form M input audio signals 122 and K-M input audio signals 124. Here it is assumed that M<K.

The M input audio signals 122 are decoded by a first decoding module 104 into M mid signals 126. The M mid signals are suitable for playback on a speaker configuration with M channels. The first decoding module 104 may generally operate according to any known decoding scheme for decoding audio content corresponding to M channels. Thus, in case the decoding system is a legacy or low complexity decoding system which only supports playback on a speaker configuration with M channels, the M mid signals may be playbacked on the M channels of the speaker configuration without the need for decoding of all the K channels of the original audio content.

In case of a decoding system which supports playback on a speaker configuration with N channels, with $M<N\leq K$, the decoding system may subject the M mid signals 126 and at least some of the K-M input audio signals 124 to a second decoding module 106 which generates N output audio signals 128 suitable for playback on the speaker configuration with N channels.

Each of the K-M input audio signals 124 corresponds to one of the M mid signals 126 according to one of two alternatives. According to a first alternative, the input audio signal 124 is a side signal corresponding to one of the M mid signals 126, such that the mid signal and the corresponding input audio signal forms a stereo signal represented on a mid/side form. According to a second alternative, the input audio signal 124 is a complementary signal corresponding to one of the M mid signals 126, such that the mid signal and the corresponding input audio signal forms a stereo signal represented on a mid/complementary/a form. Thus, according to the second alternative, a side signal may be reconstructed from the complementary signal together with the mid signal and a weighting parameter a. When the second alternative is used, the weighting parameter a is comprised in the data stream 120.

As will be explained in more detail below, some of the N output audio signals 128 of the second decoding module 106 may be direct correspondences to some of the M mid signals 126. Further, the second decoding module may comprise one or more stereo decoding modules which each operates on one of the M mid signals 126 and its corresponding input audio signal 124 to generate a pair of output audio signals, wherein each pair of generated output audio signals is suitable for playback on two of the N channels of the speaker configuration.

Figure 2:
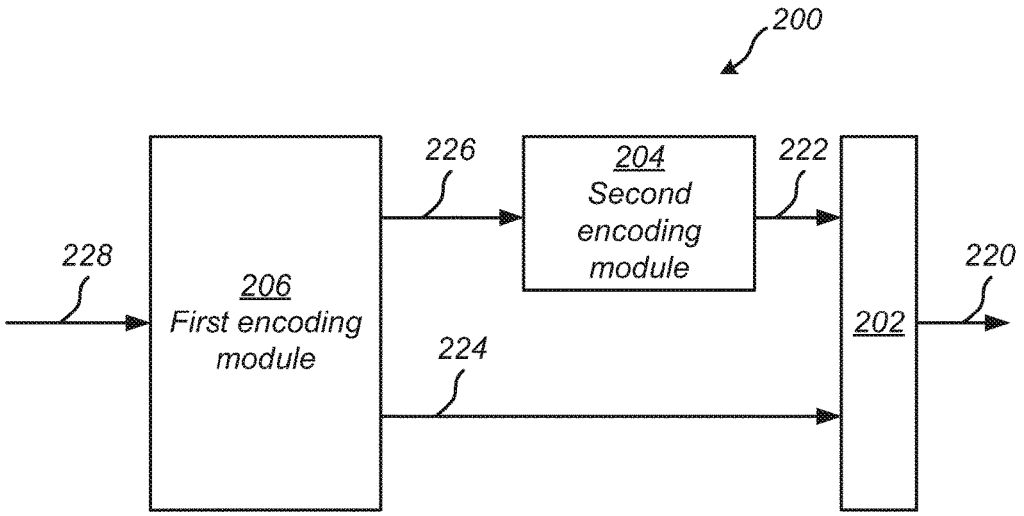
FIG. 2 illustrates an encoding scheme corresponding to the decoding scheme of FIG. 1.

FIG. 2 illustrates an encoding scheme 200 in an encoding system corresponding to the decoding scheme 100 of FIG. 1. K input audio signals 228, wherein K>2, corresponding to the channels of a speaker configuration with K channels are received by a receiving component (not shown). The K input audio signals are input to a first encoding module 206. Based on the K input audio signals 228, the first encoding module 206 generates M mid signals 226, wherein M<K≤2M, which are suitable for playback on a speaker configuration with M channels, and K-M output audio signals 224.

Generally, as will be explained in more detail below, some of the M mid signals 226, typically 2M-K of the mid signals 226, correspond to a respective one of the K input audio signals 228. In other words, the first encoding module 206 generates some of the M mid signals 226 by passing through some of the K input audio signals 228.

The remaining K-M of the M mid signals 226 are generally generated by downmixing, i.e. linearly combining, the input audio signals 228 which are not passed through the first encoding module 206. In particular, the first encoding module may downmix those input audio signals 228 pair wise. For this purpose, the first encoding module may comprise one or more (typically K-M) stereo encoding modules which each operate on a pair of input audio signals 228 to generate a mid signal (i.e. a downmix or a sum signal) and a corresponding output audio signal 224. The output audio signal 224 corresponds to the mid signal according to any one of the two alternatives discussed above, i.e. the output audio signal 224 is either a side signal or a complementary signal which together with the mid signal and a weighting parameter a allows reconstruction of a side signal. In the latter case, the weighting parameter a is included in the data stream 220.

The M mid signals 226 are then input to a second encoding module 204 in which they are encoded into M additional output audio signals 222. The second encoding module 204 may generally operate according to any known encoding scheme for encoding audio content corresponding to M channels.

The N-M output audio signals 224 from the first encoding module, and the M additional output audio signals 222 are then quantized and included in a data stream 220 by a multiplexing component 202 for transmittal to a decoder.

With the encoding/decoding schemes described with reference to FIGS. 1-2, appropriate downmixing of the K-channel audio content into a M-channel audio content is performed at the encoder side (by the first encoding module 206). In this way, efficient decoding of the K-channel audio content for playback on a channel configuration having M channels, or more generally N channels, where M≤N≤K, is achieved.

Example embodiments of decoders will be described in the following with reference to FIGS. 3-8.

Figure 3:
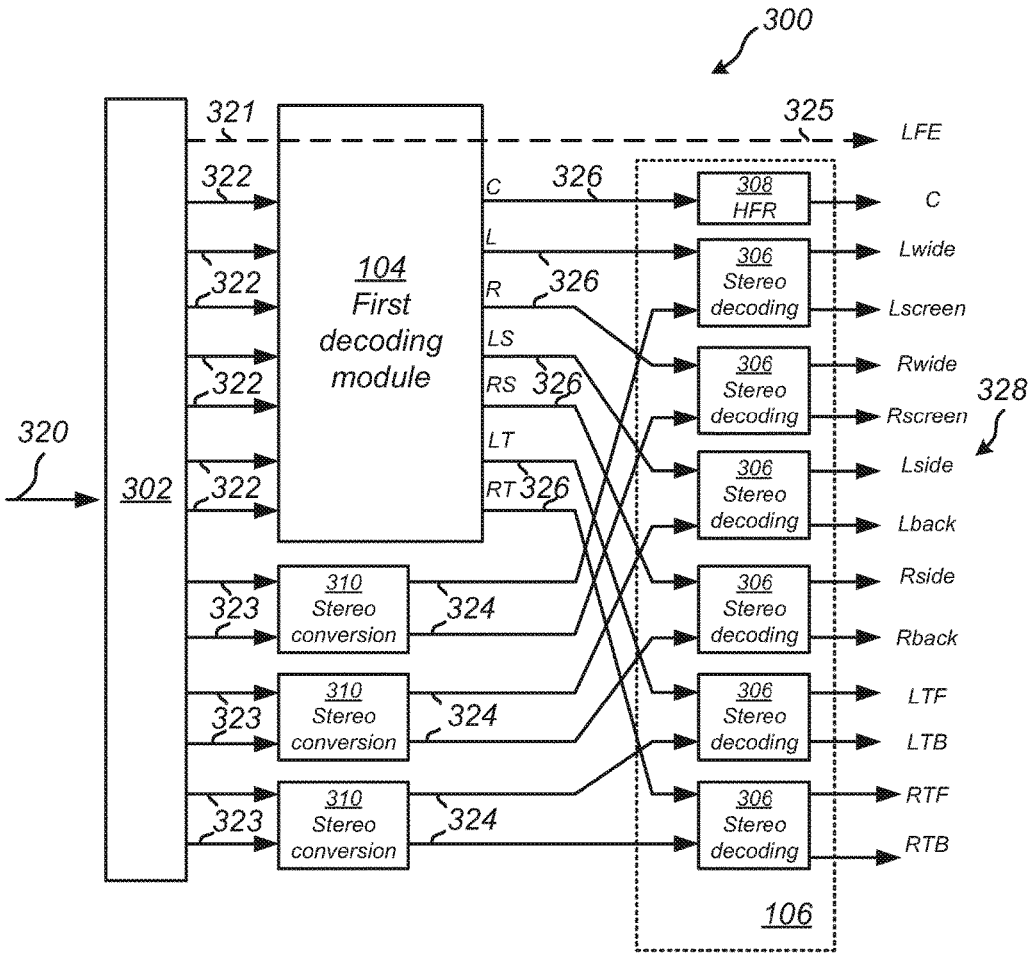
FIG. 3 illustrates an a decoder according to example embodiments.

FIG. 3 illustrates a decoder 300 which is configured for decoding of a plurality of input audio signals for playback on a speaker configuration with N channels. The decoder 300 comprises a receiving component 302, a first decoding module 104, a second decoding module 106 including stereo decoding modules 306. The second decoding module 106 may further comprise high frequency extension components 308. The decoder 300 may also comprise stereo conversion components 310.

The operation of the decoder 300 will be explained in the following. The receiving component 302 receives a data stream 320, i.e a bit stream, from an encoder. The receiving component 302 may for example comprise a demultiplexing component for demultiplexing the data stream 320 into its constituent parts, and dequantizers for dequantization of the received data.

The received data stream 320 comprises a plurality of input audio signals. Generally the plurality of input audio signals may correspond to encoded multichannel audio content corresponding to a speaker configuration with K channels, where K≥N.

In particular, the data stream 320 comprises M input audio signals 322, where 1<M<N. In the illustrated example M is equal to seven such that there are seven input audio signals 322. However, according to other examples may make take other numbers, such as five. Moreover the data stream 320 comprises N-M audio signals 323 from which N-M input audio signals 324 may be decoded. In the illustrated example N is equal to thirteen such that there are six additional input audio signals 324.

The data stream 320 may further comprise an additional audio signal 321, which typically corresponds to an encoded LFE channel.

According to an example, a pair of the N-M audio signals 323 may correspond to a joint encoding of a pair of the N-M input audio signals 324. The stereo conversion components 310 may decode such pairs of the N-M audio signals 323 to generate corresponding pairs of the N-M input audio signals 324. For example, a stereo conversion component 310 may perform decoding by applying MS or enhanced MS decoding to the pair of the N-M audio signals 323.

The M input audio signals 322, and the additional audio signal 321 if available, are input to the first decoding module 104. As discussed with reference to FIG. 1, the first decoding module 104 decodes the M input audio signals 322 into M mid signals 326 which are suitable for playback on a speaker configuration with M channels. As illustrated in the example, the M channels may correspond to a center front speaker (C), a left front speaker (L), a right front speaker (R), a left surround speaker (LS), a right surround speaker (RS), a left ceiling speaker (LT), and a right ceiling speaker (RT). The first decoding module 104 further decodes the additional audio signal 321 into an output audio signal 325 which typically corresponds to a low frequency effects, LFE, speaker.

As further discussed above with reference to FIG. 1, each of the additional input audio signals 324 corresponds to one of the mid signals 326 in that it is either a side signal corresponding to the mid signal or a complementary signal corresponding to the mid signal. By way of example, a first of the input audio signals 324 may correspond to the mid signal 326 associated with the left front speaker, a second of the input audio signals 324 may correspond to the mid signal 326 associated with the right front speaker etc.

The M mid signals 326, and the N-M audio input audio signals 324 are input to the second decoding module 106 which generates N audio signals 328 which are suitable for playback on an N-channel speaker configuration.

The second decoding module 106 maps those of the mid signals 326 that do not have a corresponding residual signal to a corresponding channel of the N-channel speaker configuration, optionally via a high frequency reconstruction component 308. For example, the mid signal corresponding to the center front speaker (C) of the M-channel speaker configuration may be mapped to the center front speaker (C) of the N-channel speaker configuration. The high frequency reconstruction component 308 is similar to those that will be described later with reference to FIGS. 4 and 5.

The second decoding module 106 comprises N-M stereo decoding modules 306, one for each pair consisting of a mid signal 326 and a corresponding input audio signal 324. Generally, each stereo decoding module 306 performs joint stereo decoding to generate a stereo audio signal which maps to two of the channels of the N-channel speaker configuration. By way of example, the stereo decoding module 306 which takes the mid signal corresponding to the left front speaker (L) of the 7-channel speaker configuration and its corresponding input audio signal 324 as input, generates a stereo audio signal which maps to two left front speakers ("Lwide" and "Lscreen") of a 13-channel speaker configuration.

The stereo decoding module 306 is operable in at least two configurations depending on a data transmission rate (bit rate) at which the encoder/decoder system operates, i.e. the bit rate at which the decoder 300 receives data. A first configuration may for example correspond to a medium bit rate, such as approximately 32-48 kbps per stereo decoding module 306. A second configuration may for example correspond to a high bit rate, such as bit rates exceeding 48 kbps per stereo decoding module 306. The decoder 300 receives an indication regarding which configuration to use. For example, such an indication may be signaled to the decoder 300 by the encoder via one or more bits in the data stream 320.

Figure 4:
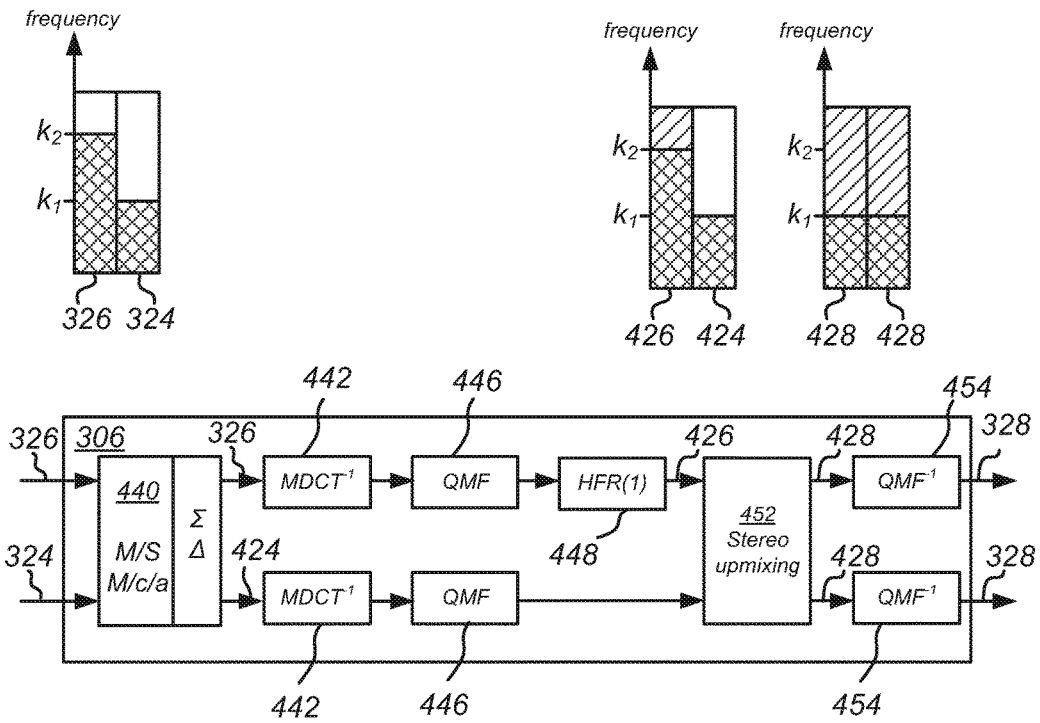
FIGS. 4 and 5 illustrate a first and a second configuration, respectively, of a decoding module according to example embodiments.

FIG. 4 illustrates the stereo decoding module 306 when it works according to a first configuration which corresponds to a medium bit rate. The stereo decoding module 306 comprises a stereo conversion component 440, various time/frequency transformation components 442, 446, 454, a high frequency reconstruction (HFR) component 448, and a stereo upmixing component 452. The stereo decoding module 306 is constrained to take a mid signal 326 and a corresponding input audio signal 324 as input. It is assumed that the mid signal 326 and the input audio signal 324 are represented in a frequency domain, typically a modified discrete cosine transform (MDCT) domain.

In order to achieve a medium bit rate, the bandwidth of at least the input audio signal 324 is limited. More precisely, the input audio signal 324 is a waveform-coded signal which comprises spectral data corresponding to frequencies up to a first frequency $k_1$. The mid signal 326 is a waveform-coded signal which comprises spectral data corresponding to frequencies up to a frequency which is larger than the first frequency $k_1$. In some cases, in order to save further bits that have to be sent in the data stream 320, the bandwidth of the mid signal 326 is also limited, such that the mid signal 326 comprises spectral data up to a second frequency $k_2$ which is larger than the first frequency $k_1$.

The stereo conversion component 440 transforms the input signals 326, 324 to a mid/side representation. As further discussed above, the mid signal 326 and the corresponding input audio signal 324 may either be represented on a mid/side form or a mid/complementary/a form. In the former case, since the input signals already are on a mid/side form, the stereo conversion component 440 thus passes the input signals 326, 324 through without any modification. In the latter case, the stereo conversion component 440 passes the mid signal 326 through whereas the input audio signal 324, which is a complementary signal, is transformed to a side signal for frequencies up to the first frequency $k_1$. More precisely, the stereo conversion component 440 determines a side signal for frequencies up to the first frequency $k_1$ by multiplying the mid signal 326 with a weighting parameter a (which is received from the data stream 320) and adding the result of the multiplication to the input audio signal 324. As a result, the stereo conversion component thus outputs the mid signal 326 and a corresponding side signal 424.

In connection to this it is worth noticing that in case the mid signal 326 and the input audio signal 324 are received in a mid/side form, no mixing of the signals 324, 326 takes place in the stereo conversion component 440. As a consequence, the mid signal 326 and the input audio signal 324 may be coded by means of a MDCT transform having different transform sizes. However, in case the mid signal 326 and the input audio signal 324 are received in a mid/complementary/a form, the MDCT coding of the mid signal 326 and the input audio signal 324 is restricted to the same transform size.

In case the mid signal 326 has a limited bandwidth, i.e. if the spectral content of the mid signal 326 is restricted to frequencies up to the second frequency $k_2$, the mid signal 326 is subjected to high frequency reconstruction (HFR) by the high frequency reconstruction component 448. By HFR is generally meant a parametric technique which, based on the spectral content for low frequencies of a signal (in this case frequencies below the second frequency $k_2$) and parameters received from the encoder in the data stream 320, reconstructs the spectral content of the signal for high frequencies (in this case frequencies above the second frequency $k_2$). Such high frequency reconstruction techniques are known in the art and include for instance spectral band replication (SBR) techniques. The HFR component 448 will thus output a mid signal 426 which has a spectral content up to the maximum frequency represented in the system, wherein the spectral content above the second frequency $k_2$ is parametrically reconstructed.

The high frequency reconstruction component 448 typically operates in a quadrature mirror filters (QMF) domain. Therefore, prior to performing high frequency reconstruction, the mid signal 326 and corresponding side signal 424 may first be transformed to the time domain by time/frequency transformation components 442, which typically performs an inverse MDCT transformation, and then transformed to the QMF domain by time/frequency transformation components 446.

The mid signal 426 and side signal 424 are then input to the stereo upmixing component 452 which generates a stereo signal 428 represented on an L/R form. Since the side signal 424 only has a spectral content for frequencies up to the first frequency $k_1$, the stereo upmixing component 452 treats frequencies below and above the first frequency $k_1$ differently.

In more detail, for frequencies up to the first frequency $k_1$, the stereo upmixing component 452 transforms the mid signal 426 and the side signal 424 from a mid/side form to an L/R form. In other words, the stereo upmixing component performs an inverse sum-difference transformation for frequencies up to the first frequency $k_1$.

For frequencies above the first frequency $k_1$, where no spectral data is provided for the side signal 424, the stereo upmixing component 452 reconstructs the first and second component of the stereo signal 428 parametrically from the mid signal 426. Generally, the stereo upmixing component 452 receives parameters which have been extracted for this purpose at the encoder side via the data stream 320, and uses these parameters for the reconstruction. Generally, any known technique for parametric stereo reconstruction may be used.

In view of the above, the stereo signal 428 which is output by the stereo upmixing component 452 thus has a spectral content up to the maximum frequency represented in the system, wherein the spectral content above the first frequency $k_1$ is parametrically reconstructed. Similarly to the HFR component 448, the stereo upmixing component 452 typically operates in the QMF domain. Thus, the stereo signal 428 is transformed to the time domain by time/frequency transformation components 454 in order to generate a stereo signal 328 represented in the time domain.

Figure 5:
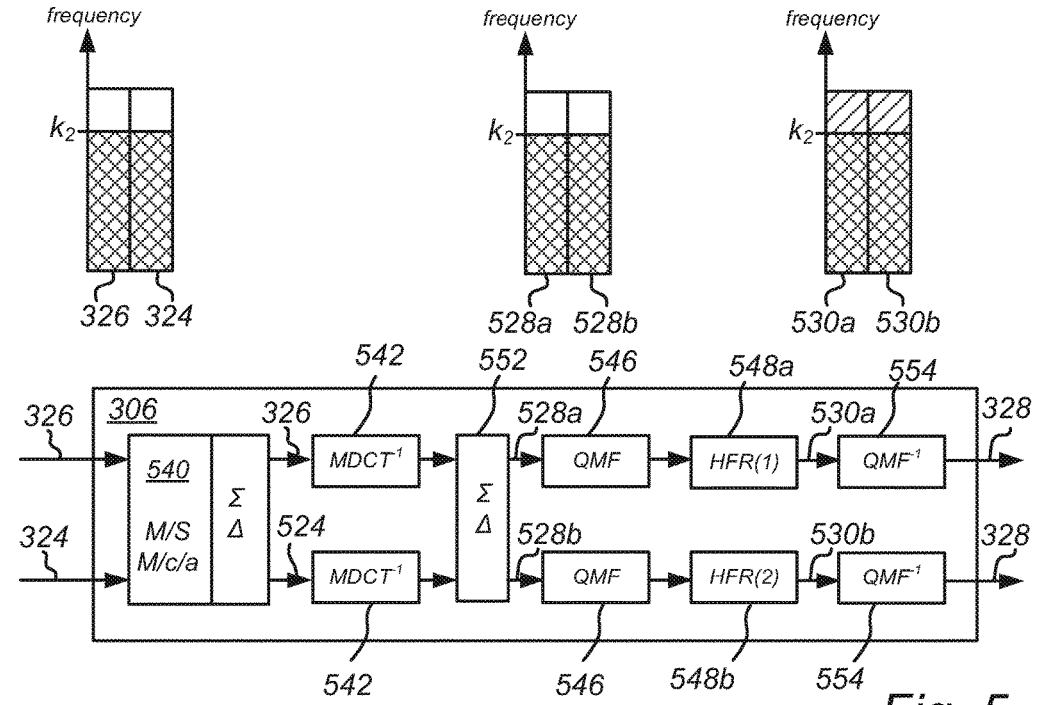

FIG. 5 illustrates the stereo decoding module 306 when it operates according to a second configuration which corresponds to a high bit rate. The stereo decoding module 306 comprises a first stereo conversion component 540, various time/frequency transformation components 542, 546, 554, a second stereo conversion component 452, and high frequency reconstruction (HFR) components 548*a*, 548*b*. The stereo decoding module 306 is constrained to take a mid signal 326 and a corresponding input audio signal 324 as input. It is assumed that the mid signal 326 and the input audio signal 324 are represented in a frequency domain, typically a modified discrete cosine transform (MDCT) domain.

In the high bit rate case, the restrictions with respect to the bandwidth of the input signals 326, 324 are different from the medium bit rate case. More precisely, the mid signal 326 and the input audio signal 324 are waveform-coded signals which comprise spectral data corresponding to frequencies up to a second frequency $k_2$. In some cases the second frequency $k_2$ may correspond to a maximum frequency represented by the system. In other cases, the second frequency $k_2$ may be lower than the maximum frequency represented by the system.

The mid signal 326 and the input audio signal 324 are input to the first stereo conversion component 540 for transformation to a mid/side representation. The first stereo conversion component 540 is similar to the stereo conversion component 440 of FIG. 4. The difference is that in the case that the input audio signal 324 is in the form of a complementary signal, the first stereo conversion component 540 transforms the complementary signal to a side signal for frequencies up to the second frequency $k_2$. Accordingly, the stereo conversion component 540 outputs the mid signal 326 and a corresponding side signal 524 which both have a spectral content up to the second frequency.

The mid signal 326 and the corresponding side signal 524 are then input to the second stereo conversion component 552. The second stereo conversion component 552 forms a sum and a difference of the mid signal 326 and the side signal 524 so as to transform the mid signal 326 and the side signal 524 from a mid/side form to an L/R form. In other words, the second stereo conversion component performs an inverse sum-and-difference transformation in order to generate a stereo signal having a first component 528*a* and a second component 528*b*.

Preferably the second stereo conversion component 552 operates in the time domain. Therefore, prior to being input to the second stereo conversion component 552, the mid signal 326 and the side signal 524 may be transformed from the frequency domain (MDCT domain) to the time domain by the time/frequency transformation components 542. As an alternative, the second stereo conversion component 552 may operate in the QMF domain. In such case, the order of components 546 and 552 of FIG. 5 would be reversed. This is advantageous in that the mixing which takes place in the second stereo conversion component 552 will not put any further restrictions on the MDCT transform sizes with respect to the mid signal 326 and the input audio signals 324. Thus, as further discussed above, in case the mid signal 326 and the input audio signal 324 are received in a mid/side form they may be coded by means of a MDCT transform using different transform sizes.

In the case that the second frequency $k_2$ is lower than the highest represented frequency, the first and second components 528*a*, 528*b* of the stereo signal may be subject high frequency reconstruction (HFR) by the high frequency reconstruction components 548*a*, 548*b*. The high frequency reconstruction components 548*a*, 548*b* are similar to the high frequency reconstruction component 448 of FIG. 4. However, in this case it is worth to note that a first set of high frequency reconstruction parameters is received, via the data stream 230, and used in the high frequency reconstruction of the first component 528*a* of the stereo signal, and a second set of high frequency reconstruction parameters is received, via the data stream 230, and used in the high frequency reconstruction of the second component 528*b* of the stereo signal. Accordingly, the high frequency reconstruction components 548*a*, 548*b* outputs a first and a second component 530*a*, 530*b* of a stereo signal which comprises spectral data up to the maximum frequency represented in the system, wherein the spectral content above the second frequency $k_2$ is parametrically reconstructed.

Preferably the high frequency reconstruction is carried out in a QMF domain. Therefore, prior to being subject to high frequency reconstruction, the first and second components 528*a*, 528*b* of the stereo signal may be transformed to a QMF domain by time/frequency transformation components 546.

The first and second components 530*a*, 530*b* of the stereo signal which is output from the high frequency reconstruction components 548 may then be transformed to the time domain by time/frequency transformation components 554 in order to generate a stereo signal 328 represented in the time domain.

Figure 6:
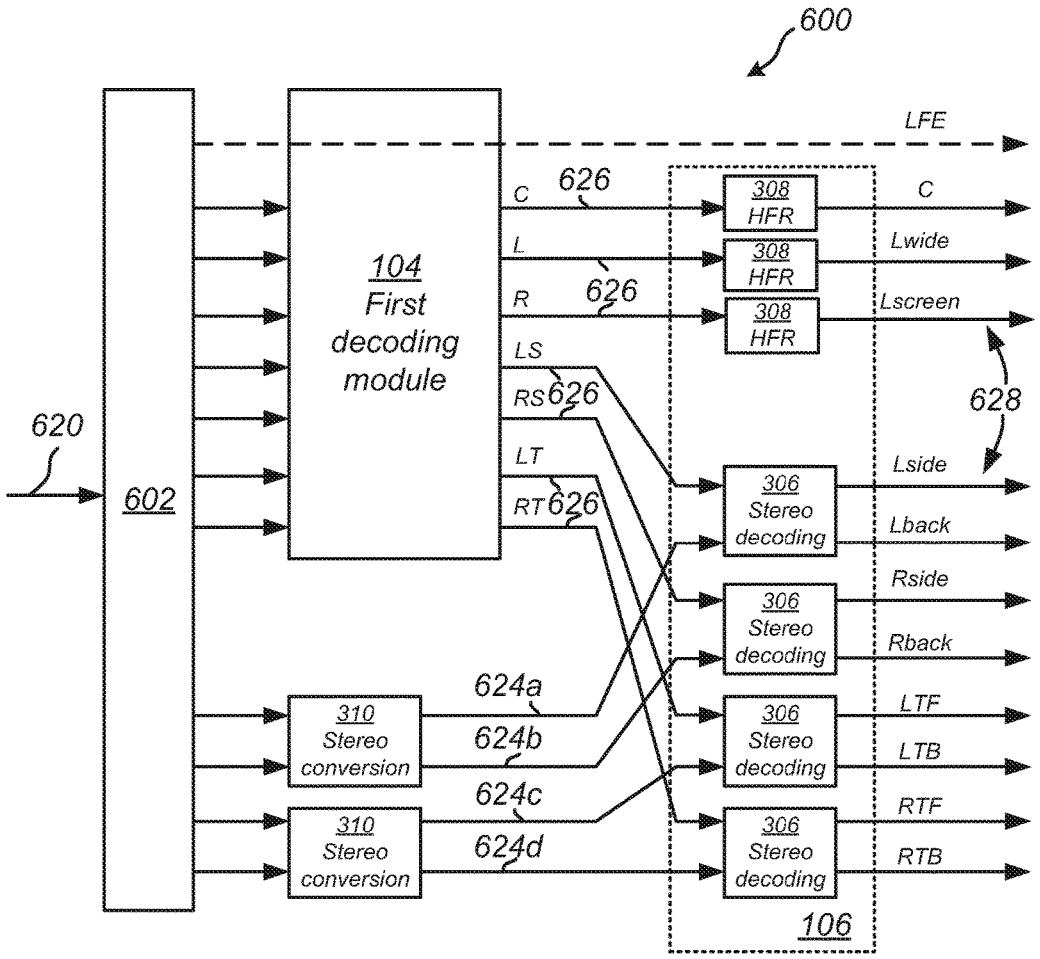
FIGS. 6 and 7 illustrate a decoder according to example embodiments.

FIG. 6 illustrates a decoder 600 which is configured for decoding of a plurality of input audio signals comprised in a data stream 620 for playback on a speaker configuration with 11.1 channels. The structure of the decoder 600 is generally similar to that illustrated in FIG. 3. The difference is that the illustrated number of channels of the speaker configuration is lower in comparison to FIG. 3 where a speaker configuration with 13.1 channels is illustrated having a LFE speaker, three front speakers (center C, left L, and right R), four surround speakers (left side Lside, left back Lback, right side Rside, right back Rback), and four ceiling speakers (left top front LTF, left top back LTB, right top front RTF, and right top back RTB).

In FIG. 6 the first decoding component 104 outputs seven mid signals 626 which may correspond to a speaker configuration the channels C, L, R, LS, RS, LT and RT. Moreover, there are four additional input audio signals 624*a-d*. The additional input audio signals 624*a-d* each corresponds to one of the mid signals 626. By way of example, the input audio signal 624*a* may be a side signal or a complementary signal corresponding to the LS mid signal, the input audio signal 624*b* may be a side signal or a complementary signal corresponding to the RS mid signal, input audio signal 624*c* may be a side signal or a complementary signal corresponding to the LT mid signal, and the input audio signal 624*d* may be a side signal or a complementary signal corresponding to the RT mid signal.

In the illustrated embodiment, the second decoding module 106 comprises four stereo decoding modules 306 of the type illustrated in FIGS. 4 and 5. Each stereo decoding module 306 takes one of the mid signals 626 and the corresponding additional input audio signal 624*a-d* as input and outputs a stereo audio signal 328. For example, based on the LS mid signal and the input audio signal 624*a*, the second decoding module 106 may output a stereo signal corresponding to a Lside and a Lback speaker. Further examples are evident from the figure.

Further, the second decoding module 106 acts as a pass through of three of the mid signals 626, here the mid signals corresponding to the C, L, and R channels. Depending on the spectral bandwidth of these signals, the second decoding module 106 may perform high frequency reconstruction using high frequency reconstruction components 308.

Figure 7:
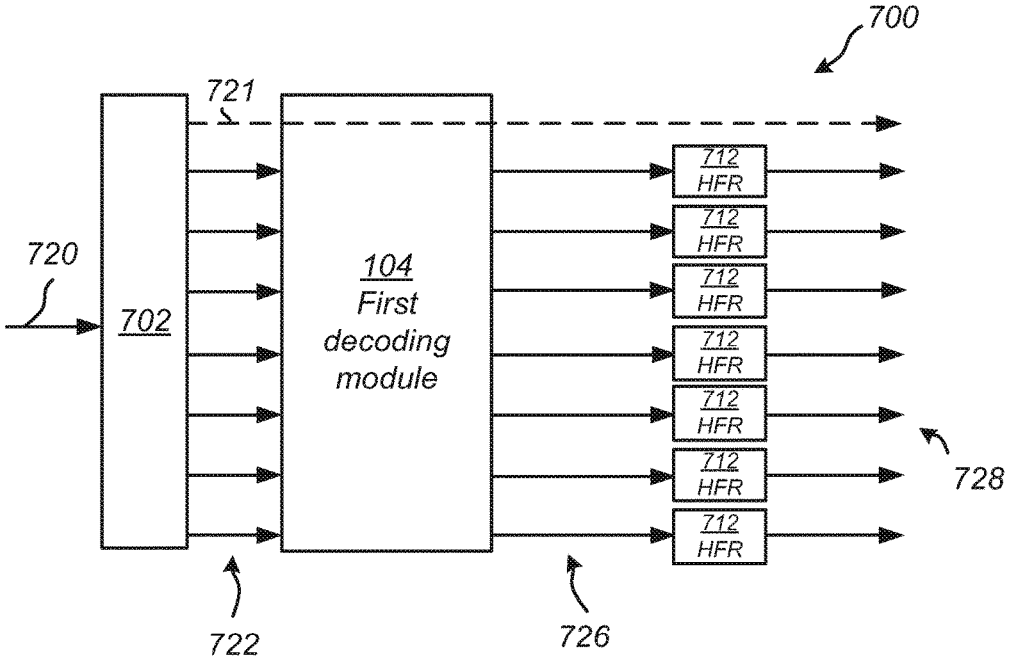

FIG. 7 illustrates how a legacy or low-complexity decoder 700 decodes the multichannel audio content of a data stream 720 corresponding to a speaker configuration with K channels for playback on a speaker configuration with M channels. By way of example, K may be equal to eleven or thirteen, and M may be equal to seven. The decoder 700 comprises a receiving component 702, a first decoding module 704, and high frequency reconstruction modules 712.

As further described with reference to the data stream 120 FIG. 1, the data stream 720 may generally comprise M input audio signals 722 (cf. signals 122 and 322 in FIGS. 1 and 3) and K-M additional input audio signals (cf. signals 124 and 324 in FIGS. 1 and 3). Optionally, the data stream 720 may comprise an additional audio signal 721, typically corresponding to an LFE-channel. Since the decoder 700 corresponds to a speaker configuration with M channels, the receiving component 702 only extracts the M input audio signals 722 (and the additional audio signal 721 if present) from the data stream 720 and discards the remaining K-M additional input audio signals.

The M input audio signals 722, here illustrated by seven audio signals, and the additional audio signal 721 are then input to the first decoding module 104 which decodes the M input audio signals 722 into M mid signals 726 which correspond to the channels of the M-channel speaker configuration.

In case the M mid signals 726 only comprises spectral content up to a certain frequency which is lower than a maximum frequency represented by the system, the M mid signals 726 may be subject to high frequency reconstruction by means of high frequency reconstruction modules 712.

Figure 8:
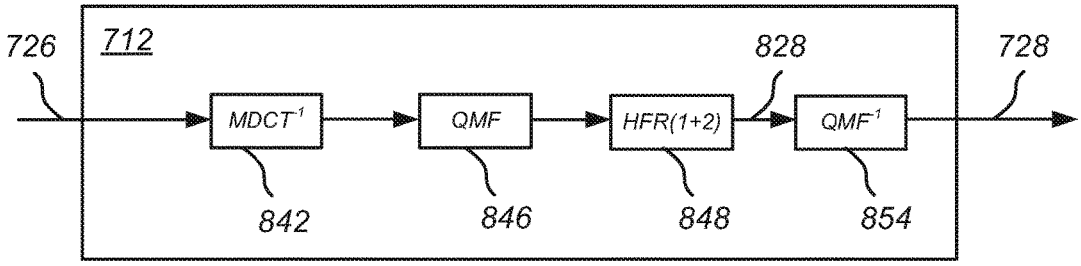
FIG. 8 illustrates a high frequency reconstruction component used in the decoder of FIG. 7.

FIG. 8 illustrates an example of such a high frequency reconstruction module 712. The high frequency reconstruction module 712 comprises a high frequency reconstruction component 848, and various time/frequency transformation components 842, 846, 854.

The mid signal 726 which is input to the HFR module 712 is subject to high frequency reconstruction by means of the HFR component 848. The high frequency reconstruction is preferably performed in the QMF domain. Therefore, the mid signal 726, which typically is in the form of a MDCT spectra, may be transformed to the time domain by time/frequency transformation component 842, and then to the QMF domain by time/frequency transformation component 846, prior to being input to the HFR component 848.

The HFR component 848 generally operates in the same manner as e.g. HFR components 448, 548 of FIGS. 4 and 5 in that it uses the spectral content of the input signal for lower frequencies together with parameters received from the data stream 720 in order to parametrically reconstruct spectral content for higher frequencies. However, depending on the bit rate of the encoder/decoder system, the HFR component 848 may use different parameters.

As explained with reference to FIG. 5, for high bit rate cases and for each mid signal having a corresponding additional input audio signal, the data stream 720 comprises a first set of HFR parameters, and a second set of HFR parameters (cf. the description of items 548*a*, 548*b* of FIG. 5). Even though the decoder 700 does not use the additional input audio signal corresponding to the mid signal, the HFR component 848 may use a combination of the first and second sets of HFR parameters when performing high frequency reconstruction of the mid signal. For example, the high frequency reconstruction component 848 may use a downmix, such as an average or a linear combination, of the HFR parameters of the first and the second set.

The HFR component 854 thus outputs a mid signal 828 having an extended spectral content. The mid signal 828 may then be transformed to the time domain by means of the time/frequency transformation component 854 in order to give an output signal 728 having a time domain representation.

Example embodiments of encoders will be described in the following with reference to FIGS. 9-11.

Figure 9:
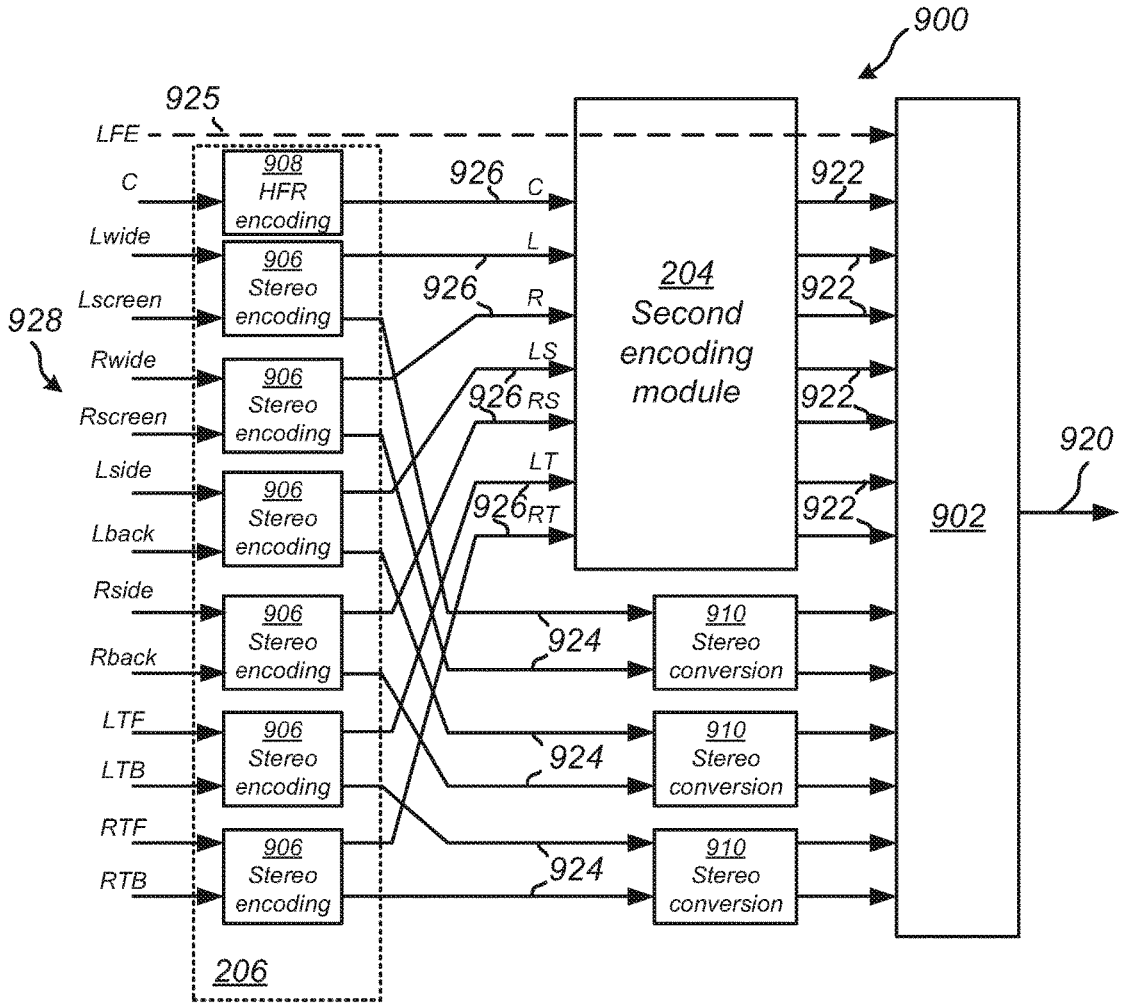
FIG. 9 illustrates an encoder according to example embodiments.

FIG. 9 illustrates an encoder 900 which falls under the general structure of FIG. 2. The encoder 900 comprises a receiving component (not shown), a first encoding module 206, a second encoding module 204, and a quantizing and multiplexing component 902. The first encoding module 206 may further comprise high frequency reconstruction (HFR) encoding components 908, and stereo encoding modules 906. The decoder 900 may comprise further stereo conversion components 910.

The operation of the encoder 900 will now be explained. The receiving component receives K input audio signals 928 corresponding to the channels of a speaker configuration with K channels. For example, the K channels may correspond to the channels of a 13 channel configuration as described above. Further an additional channel 925 typically corresponding to an LFE channel may be received. The K channels are input to a first encoding module 206 which generates M mid signals 926 and K-M output audio signals 924.

The first encoding module 206 comprises K-M stereo encoding modules 906. Each of the K-M stereo encoding modules 906 takes two of the K input audio signals as input and generates one of the mid signals 926 and one of the output audio signals 924 as will be explained in more detail below.

The first encoding module 206 further maps the remaining input audio signals, which are not input to one of the stereo encoding modules 906, to one of the M mid signals 926, optionally via a HFR encoding component 908. The HFR encoding component 908 is similar to those that will be described with reference to FIGS. 10 and 11.

The M mid signals 926, optionally together with the additional input audio signal 925 which typically represents the LFE channel, is input to the second encoding module 204 as described above with reference to FIG. 2 for encoding into M output audio channels 922.

Prior to being included in the data stream 920, the K-M output audio signals 924 may optionally be encoded pair wise by means of the stereo conversion components 910. For example, a stereo conversion component 910 may encode a pair of the K-M output audio signals 924 by performing MS or enhanced MS coding.

The M output audio signals 922 (and the additional signal resulting from the additional input audio signal 925) and the K-M output audio signals 924 (or the audio signals which are output from the stereo encoding components 910) are quantized and included in a data stream 920 by the quantizing and multiplexing component 902. Moreover, parameters which are extracted by the different encoding components and modules may be quantized and included in the data stream.

The stereo encoding module 906 is operable in at least two configurations depending on a data transmission rate (bit rate) at which the encoder/decoder system operates, i.e. the bit rate at which the encoder 900 transmits data. A first configuration may for example correspond to a medium bit rate. A second configuration may for example correspond to a high bit rate. The encoder 900 includes an indication regarding which configuration to use in the data stream 920. For example, such an indication may be signaled via one or more bits in the data stream 920.

Figure 10:
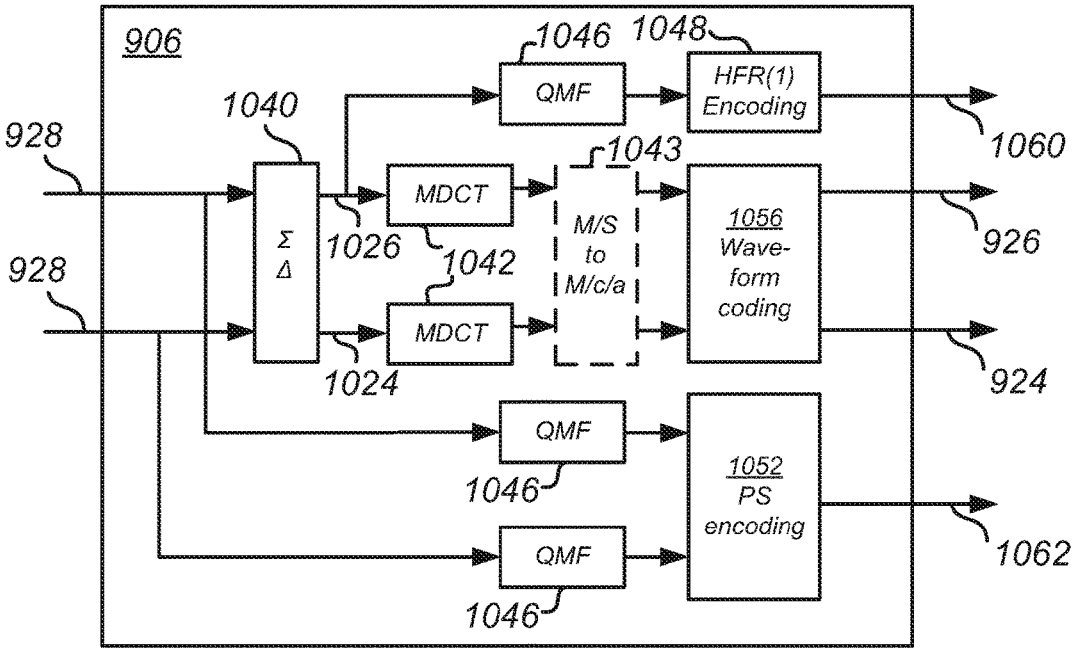
FIGS. 10 and 11 illustrate a first and a second configuration, respectively, of an encoding module according to example embodiments.

FIG. 10 illustrates the stereo encoding module 906 when it operates according to a first configuration which corresponds to a medium bit rate. The stereo encoding module 906 comprises a first stereo conversion component 1040, various time/frequency transformation components 1042, 1046, a HFR encoding component 1048, a parametric stereo encoding component 1052, and a waveform-coding component 1056. The stereo encoding module 906 may further comprise a second stereo conversion component 1043. The stereo encoding module 906 takes two of the input audio signals 928 as input. It is assumed that the input audio signals 928 are represented in a time domain.

The first stereo conversion component 1040 transforms the input audio signals 928 to a mid/side representation by forming sum and differences according to the above. Accordingly, the first stereo conversion component 940 outputs a mid signal 1026, and a side signal 1024.

In some embodiments, the mid signal 1026 and the side signal 1024 are then transformed to a mid/complementary/a representation by the second stereo conversion component 1043. The second stereo conversion component 1043 extracts the weighting parameter a for inclusion in the data stream 920. The weighting parameter a may be time and frequency dependent, i.e. it may vary between different time frames and frequency bands of data.

The waveform-coding component 1056 subjects the mid signal 1026 and the side or complementary signal to waveform-coding so as to generate a waveform-coded mid signal 926 and a waveform-coded side or complementary signal 924.

The second stereo conversion component 1043 and the waveform-coding component 1056 typically operate in a MDCT domain. Thus the mid signal 1026 and the side signal 1024 may be transformed to the MDCT domain by means of time/frequency transformation components 1042 prior to the second stereo conversion and the waveform-coding. In case the signals 1026 and 1024 are not subject to the second stereo conversion 1043, different MDCT transform sizes may be used for the mid signal 1026 and the side signal 1024. In case the signals 1026 and 1024 are subject to the second stereo conversion 1043, the same MDCT transform sizes should be used for the mid signal 1026 and the complementary signal 1024.

In order to achieve a medium bit rate, the bandwidth of at least the side or complementary signal 924 is limited. More precisely, the side or complementary signal is waveform-coded for frequencies up to a to a first frequency $k_1$. Accordingly, the waveform-coded side or complementary signal 924 comprises spectral data corresponding to frequencies up to the first frequency $k_1$. The mid signal 1026 is waveform-coded for frequencies up to a frequency which is larger than the first frequency $k_1$. Accordingly, the mid signal 926 comprises spectral data corresponding to frequencies up to a frequency which is larger than the first frequency $k_1$. In some cases, in order to save further bits that have to be sent in the data stream 920, the bandwidth of the mid signal 926 is also limited, such that the waveform-coded mid signal 926 comprises spectral data up to a second frequency $k_2$ which is larger than the first frequency $k_1$.

In case the bandwidth of the mid signal 926 is limited, i.e. if the spectral content of the mid signal 926 is restricted to frequencies up to the second frequency $k_2$, the mid signal 1026 is subjected to HFR encoding by the HFR encoding component 1048. Generally, the HFR encoding component 1048 analyzes the spectral content of the mid signal 1026 and extracts a set of parameters 1060 which enable reconstruction of the spectral content of the signal for high frequencies (in this case frequencies above the second frequency $k_2$) based on the spectral content of the signal for low frequencies (in this case frequencies above the second frequency $k_2$). Such HFR encoding techniques are known in the art and include for instance spectral band replication (SBR) techniques. The set of parameters 1060 are included in the data stream 920.

The HFR encoding component 1048 typically operates in a quadrature mirror filters (QMF) domain. Therefore, prior to performing HFR encoding, the mid signal 1026 may be transformed to the QMF domain by time/frequency transformation component 1046.

The input audio signals 928 (or alternatively the mid signal 1046 and the side signal 1024) are subject to parametric stereo encoding in the parametric stereo (PS) encoding component 1052. Generally, the parametric stereo encoding component 1052 analyzes the input audio signals 928 and extracts parameters 1062 which enable reconstruction of the input audio signals 928 based on the mid signal 1026 for frequencies above the first frequency $k_1$. The parametric stereo encoding component 1052 may apply any known technique for parametric stereo encoding. The parameters 1062 are included in the data stream 920.

The parametric stereo encoding component 1052 typically operates in the QMF domain. Therefore, the input audio signals 928 (or alternatively the mid signal 1046 and the side signal 1024) may be transformed to the QMF domain by time/frequency transformation component 1046.

Figure 11:
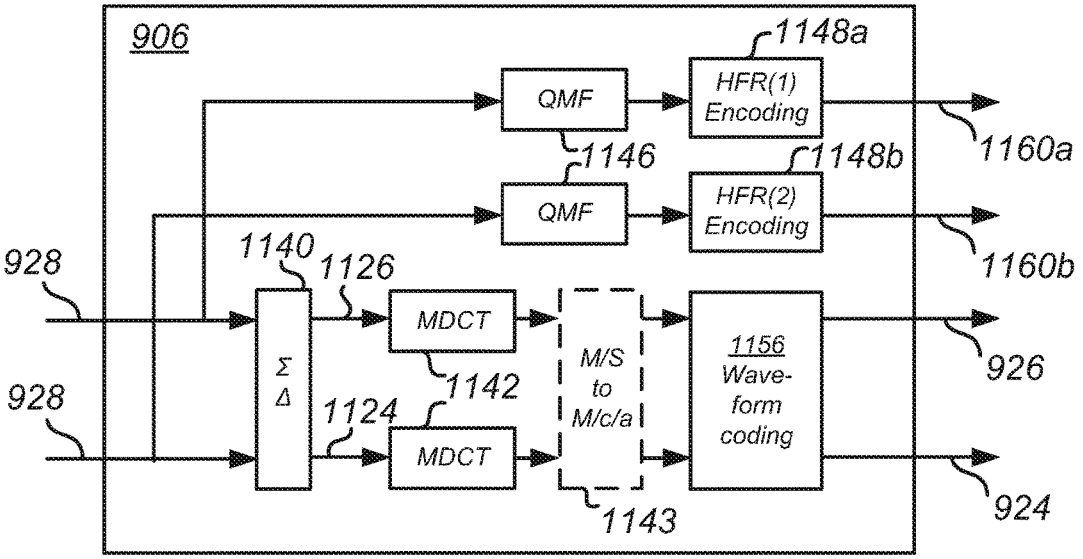

FIG. 11 illustrates the stereo encoding module 906 when it operates according to a second configuration which corresponds to a high bit rate. The stereo encoding module 906 comprises a first stereo conversion component 1140, various time/frequency transformation components 1142, 1146, HFR encoding components 1048*a*, 1048*b*, and a waveform-coding component 1156. Optionally, the stereo encoding module 906 may comprise a second stereo conversion component 1143. The stereo encoding module 906 takes two of the input audio signals 928 as input. It is assumed that the input audio signals 928 are represented in a time domain.

The first stereo conversion component 1140 is similar to the first stereo conversion component 1040 and transforms the input audio signals 928 to a mid signal 1126, and a side signal 1124.

In some embodiments, the mid signal 1126 and the side signal 1124 are then transformed to a mid/complementary/a representation by the second stereo conversion component 1143. The second stereo conversion component 1043 extracts the weighting parameter a for inclusion in the data stream 920. The weighting parameter a may be time and frequency dependent, i.e. it may vary between different time frames and frequency bands of data. The waveform-coding component 1156 then subjects the mid signal 1126 and the side or complementary signal to waveform-coding so as to generate a waveform-coded mid signal 926 and a waveform-coded side or complementary signal 924.

The waveform-coding component 1156 is similar to the waveform-coding component 1056 of FIG. 10. An important difference however appears with respect to the bandwidth of the output signals 926, 924. More precisely, the waveform-coding component 1156 performs waveform-coding of the mid signal 1126 and the side or complementary signal up to a second frequency $k_2$ (which is typically larger than the first frequency $k_1$ described with respect to the mid rate case). As a result the waveform-coded mid signal 926 and waveform-coded side or complementary signal 924 comprise spectral data corresponding to frequencies up to the second frequency $k_2$. In some cases the second frequency $k_2$ may correspond to a maximum frequency represented by the system. In other cases, the second frequency $k_2$ may be lower than the maximum frequency represented by the system.

In case the second frequency $k_2$ is lower than the maximum frequency represented by the system, the input audio signals 928 are subject to HFR encoding by the HFR components 1148*a*, 1148*b*. Each of the HFR encoding components 1148*a*, 1148*b* operates similar to the HFR encoding component 1048 of FIG. 10. Accordingly, the HFR encoding components 1148*a*, 1148*b* generate a first set of parameters 1160*a* and a second set of parameters 1160*b*, respectively, which enable reconstruction of the spectral content of the respective input audio signal 928 for high frequencies (in this case frequencies above the second frequency $k_2$) based on the spectral content of the input audio signal 928 for low frequencies (in this case frequencies above the second frequency $k_2$). The first and second set of parameters 1160*a*, 1160*b* are included in the data stream 920.

EQUIVALENTS, EXTENSIONS, ALTERNATIVES AND MISCELLANEOUS

Further embodiments of the present disclosure will become apparent to a person skilled in the art after studying the description above. Even though the present description and drawings disclose embodiments and examples, the disclosure is not restricted to these specific examples. Numerous modifications and variations can be made without departing from the scope of the present disclosure, which is defined by the accompanying claims. Any reference signs appearing in the claims are not to be understood as limiting their scope.

Additionally, variations to the disclosed embodiments can be understood and effected by the skilled person in practicing the disclosure, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The systems and methods disclosed hereinabove may be implemented as software, firmware, hardware or a combination thereof. In a hardware implementation, the division of tasks between functional units referred to in the above description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

All the figures are schematic and generally only show parts which are necessary in order to elucidate the disclosure, whereas other parts may be omitted or merely suggested. Unless otherwise indicated, like reference numerals refer to like parts in different figures.

The invention claimed is:

1. A method for decoding an encoded audio signal, the method comprising:

receiving a plurality of input audio signals, the plurality of input audio signals including a first waveform-coded signal comprising spectral data corresponding to frequencies up to a first frequency and a second waveform-coded signal comprising spectral data corresponding to frequencies up to a second frequency, the second frequency being higher than the first frequency;

decoding the first waveform-coded signal to produce a first decoded audio signal having frequencies up to the first frequency, the first decoded audio signal representing a side signal;

decoding the second waveform-coded signal to produce a second decoded audio signal having frequencies up to the second frequency, the second decoded audio signal representing a mid signal;

performing an enhanced inverse sum-difference transformation with the first decoded signal and the second decoded signal to produce a stereo audio signal up to the first frequency, wherein the enhanced inverse sum-difference transformation includes applying a weighting parameter to the mid signal;

performing an inverse sum-difference transformation with the second decoded signal to produce a stereo audio signal up to the second frequency; and combining the stereo audio signal having frequencies up to the first frequency with the stereo audio signal having frequencies up to the second frequency.

2. The method of claim 1 wherein the weighting parameter is time variant.

3. The method of claim 1 wherein the enhanced inverse sum-difference transformation generates a left channel, L, according to L=(1+a)A+B, where a is the weighting parameter, A is the mid signal, and B is the side signal.

4. The method of claim 1 wherein the enhanced inverse sum-difference transformation generates a right channel, R, according to R=(1−a)A−B, where a is the weighting parameter, A is the mid signal and B is the side signal.

5. The method of claim 1 wherein the weighting parameter is real-valued.

6. The method of claim 1 wherein the weighting parameter is included in the encoded audio signal.

7. An audio decoder for decoding an encoded audio signal, the audio decoder comprising:

an interface that receives a plurality of input audio signals, the plurality of input audio signals including a first waveform-coded signal comprising spectral data corresponding to frequencies up to a first frequency and a second waveform-coded signal comprising spectral data corresponding to frequencies up to a second frequency, the second frequency being higher than the first frequency;

a decoder that decodes the first waveform-coded signal to produce a first decoded audio signal having frequencies up to the first frequency, the first decoded audio signal representing a side signal;

a decoder that decodes the second waveform-coded signal to produce a second decoded audio signal having frequencies up to the second frequency, the second decoded audio signal representing a mid signal;

a transformer that performs an enhanced inverse sum-difference transformation with the first decoded signal and the second decoded signal to produce a stereo audio signal up to the first frequency, wherein the enhanced inverse sum-difference transformation includes applying a weighting parameter to the mid signal;

a transformer that performs an inverse sum-difference transformation with the second decoded signal to produce a stereo audio signal up to the second frequency; and a synthesizer that combines the stereo audio signal having frequencies up to the first frequency with the stereo audio signal having frequencies up to the second frequency.

8. The audio decoder of claim 7 wherein the weighting parameter is time variant.

9. The audio decoder of claim 7 wherein the enhanced inverse sum-difference transformation generates a left channel, L, according to L=(1+a)A+B, where a is the weighting parameter, A is the mid signal, and B is the side signal.

10. The audio decoder of claim 7 wherein the enhanced inverse sum-difference transformation generates a right channel, R, according to R=(1−a)A−B, where a is the weighting parameter, A is the mid signal and B is the side signal.

11. The audio decoder of claim 7 wherein the weighting parameter is real-valued.

12. The audio decoder of claim 7 wherein the weighting parameter is included in the encoded audio signal.

* * * * *